US005744020A

United States Patent [19]

Akiyama et al.

[11] Patent Number: 5,744,020

[45] Date of Patent: Apr. 28, 1998

[54] PROCESS FOR TREATMENT OF RADIOACTIVE WASTE

[75] Inventors: Takao Akiyama; Yoichi Miyamoto, both of Mito; Shunji Inoue; Yoshihiko Kurashima, both of Nagoya; Yoichi Karita, Handa, all of Japan

[73] Assignees: Douryokuro Kakunenryo Kaihatsu Jigyoudan, Tokyo; NGK Insulators, Ltd., Nagoya, both of Japan

[21] Appl. No.: 739,955

[22] Filed: Oct. 30, 1996

[30] Foreign Application Priority Data

Nov. 1, 1995 [JP] Japan ..... 7-285177

[51] Int. Cl.[6] ..... C25B 1/16

[52] U.S. Cl. ..... 205/408; 205/406; 205/407; 205/43; 588/1; 588/20; 588/204

[58] Field of Search ..... 205/408, 409, 205/407, 406, 43; 588/1, 20, 204

[56] References Cited

U.S. PATENT DOCUMENTS

| | | | |
|---|---|---|---|
| 4,041,129 | 8/1977 | Foster et al. | 423/234 |
| 4,276,145 | 6/1981 | Skala | 204/247 |
| 4,772,449 | 9/1988 | Bones et al. | 419/2 |
| 4,956,057 | 9/1990 | Stucki et al. | 204/101 |
| 5,434,334 | 7/1995 | Lomasney et al. | 588/20 |

FOREIGN PATENT DOCUMENTS

| | | |
|---|---|---|
| 48-070362 A | of 1973 | Japan . |
| 53-015296 A | 2/1978 | Japan . |
| 53-015297 | 2/1978 | Japan . |
| 54-067506 A | 5/1979 | Japan . |
| 55-042463 B | 10/1980 | Japan . |
| 59-007796 B | 2/1984 | Japan . |
| 60-057516 B | 12/1985 | Japan . |
| 61-1511 B2 | 1/1986 | Japan . |
| 62-163731 A | 7/1987 | Japan . |
| 03-039698 A | 2/1991 | Japan . |
| 04-283700 A | 10/1992 | Japan . |
| 06-082597 A | 3/1994 | Japan . |
| 816962 B | 3/1981 | U.S.S.R. . |
| 1300465 | 12/1972 | United Kingdom . |

*Primary Examiner*—Arun S. Phasge
*Attorney, Agent, or Firm*—Kubovcik & Kubovcik

[57] ABSTRACT

A process for treating a radioactive waste, includes drying a radioactive waste containing a radioactive substance(s) and a sodium compound(s), to convert it into a dried material, heating the dried material to convert it into a molten salt, and subjecting the molten salt to electrolysis using the salt as an anolyte and β-alumina as a sodium ion-permeable membrane. This process can recover metallic sodium or sodium hydroxide, each of extremely low radioactivity from a radioactive waste containing a radioactive substance(s) and a sodium compound(s), at a high purity at a high current efficiency.

22 Claims, 2 Drawing Sheets

PROCESS FOR TREATMENT OF RADIOACTIVE WASTE

BACKGROUND OF THE INVENTION (1) Field of the Invention

The present invention relates to a process for treatment of radioactive wastes generated in nuclear facilities.

(2) Description of Related Art

In nuclear fuel reprocessing plants, nitric acid ($HNO_3$) is used in the reprocessing step and excessive $HNO_3$ is treated with sodium hydroxide (NaOH), resulting in formation of sodium nitrate ($NaNO_3$) as a waste. In nuclear power plants, an ion exchange resin is used for purification of cooling water and, for the regeneration of the used resin, sulfuric acid and sodium hydroxide are used, resulting in formation of sodium sulfate ($Na_2SO_4$) as a waste. In incinerators installed at nuclear facilities, chlorides (e.g. polyvinyl chloride) are incinerated; the hydrogen chloride gas contained in the combustion gas is as necessary removed with water in a washing tower; and the resulting water is neutralized with sodium hydroxide (NaOH), resulting in formation of sodium chloride (NaCl) as a waste.

As mentioned above, wastes composed mainly of sodium compounds are formed in nuclear facilities. Since these radioactive wastes cannot be discharged per se out of the facilities, they are stored per se or after concentration or drying. Their amount under storage is increasing year by year and a need has arisen for volume reduction or reutilization of the radioactive wastes. If the above radioactive wastes composed mainly of sodium compounds can be decomposed into or recovered as non-radioactive sodium hydroxide and a non-radioactive acid (e.g. nitric acid), storage of radioactive wastes and procurement of sodium hydroxide and acid becomes unnecessary, resulting in significant reduction in the wastes generated. For such an attempt, it is under way to decompose a radioactive waste for the recovery in other forms, by electrolysis using an ion exchange membrane.

In such conventional recovery methods, however, there were various problems such as (1) the alkali solution and acid solution recovered have a low concentration and accordingly cannot be reutilized; (2) radioactive substances are difficult to remove at a high level and cannot be converted into a non-radioactive solution and, therefore, must be handled with utmost care for prevention of radiation exposure, etc.; and (3) various apparatuses must be used in combination and the ion exchange membrane cannot afford a large current density and, therefore, a large facility is required.

OBJECT AND SUMMARY OF THE INVENTION

The present invention has been made in order to solve the above-mentioned problems of the related art.

According to the present invention, there is provided a process for treating a radioactive waste, which comprises drying a radioactive waste containing a radioactive substance(s) and a sodium compound(s), to convert it into a dried material, heating the dried material to convert it into a molten salt, and subjecting the molten salt to electrolysis using the salt as an anolyte and β-alumina as a sodium ion-permeable membrane.

DETAILED DESCRIPTION OF THE INVENTION

Figure 1:
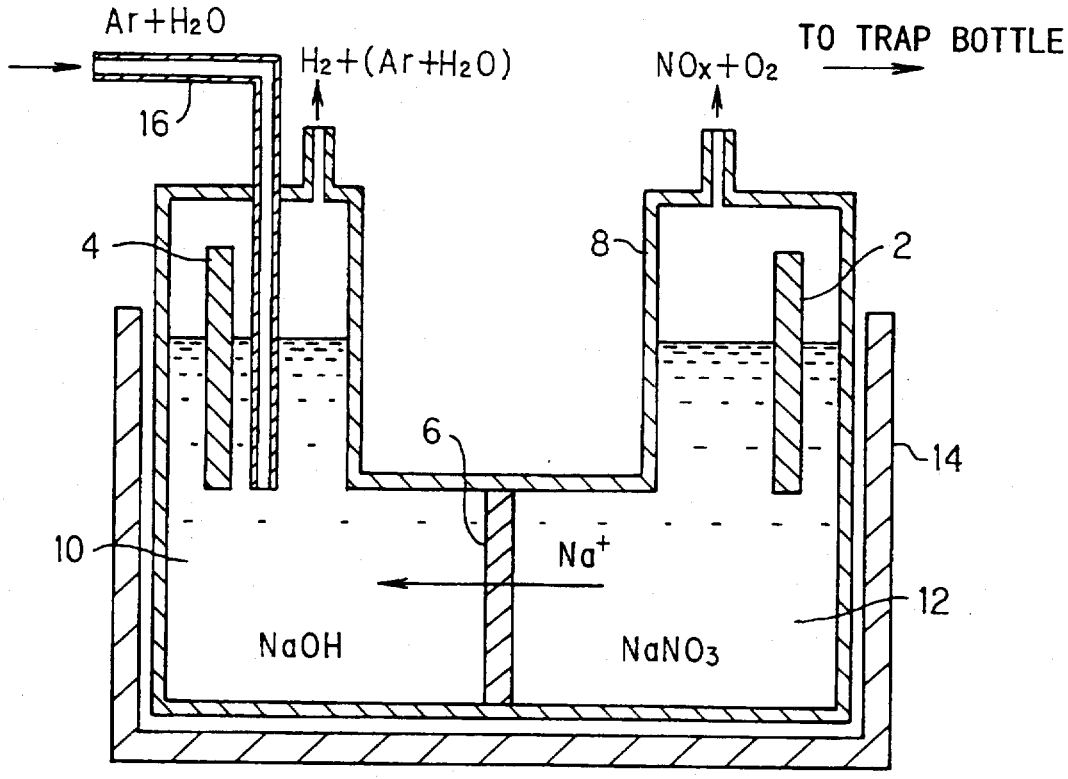
FIG. 1 is a drawing showing the outline of the apparatus used in Example 1.

In the present process, a radioactive waste containing a radioactive substance(s) and a sodium compound(s) are subjected to electrolysis using β-alumina as a sodium ion-permeable membrane, whereby non-radioactive (or extremely low radioactive), highly pure (solid) metallic sodium or sodium hydroxide can be formed at the cathode side.

The present inventor thought of molten salt electrolysis for treatment of radioactive waste and tried the technique for treatment of radioactive waste. As a result, the present inventor surprisingly found out that non-radioactive, highly pure metallic sodium or sodium hydroxide is formed at the cathode side. The present invention has been completed based on the finding. In the present process, with the progress of electrolysis, the radioactive substance(s) is (are) concentrated at the anode side; after the lapse of a certain length of time, the concentrated radioactive substance(s) is (are) taken out of the electrolyzer and made harmless by an appropriate means such as containment with cement or the like.

In the present invention, there is used, as the anolyte of electrolysis, a molten salt obtained by drying a radioactive waste containing a radioactive substance(s) and a sodium compound(s), to convert it into a dried material and heating the dried material. Meanwhile, there is used, as the catholyte of electrolysis, a melt containing sodium hydroxide, or molten metallic sodium. As the permeable membrane, β-alumina is used ordinarily; however, it may be replaced by β"-alumina or β'"-alumina. β"-Alumina or β'"-alumina is superior to β-alumina in sodium-ion permeability and enables the flow of higher-density current therethrough.

In the present invention, when a melt containing sodium hydroxide is used as the catholyte, electrolysis is conducted while steam or steam plus oxygen are being fed into the catholyte. When steam alone is fed, the excessive portion of steam generates hydrogen gas (this is combustible) at the cathode side. As described later, this hydrogen gas can be used for the catalytic reduction of a nitrogen oxide gas which is generated at the anode side in the treatment of a radioactive waste containing sodium nitrate. When steam and oxygen are fed, the generation of combustible hydrogen gas can be prevented by feeding the oxygen in an amount at least stoichiometric to the amount of the steam. When molten metallic sodium is used as the catholyte, the feeding of steam or steam plus oxygen as mentioned above is unnecessary.

The sodium compound(s) contained in the radioactive waste to be treated by the present process differs (differ) depending upon the facility or reprocessing step where the waste is generated. However, the sodium compound(s) is (are) composed mainly of sodium nitrate in the waste generated at the reprocessing step of a nuclear fuel reprocessing plant; is (are) composed mainly of sodium sulfate in the waste generated at the regeneration step of ion exchange resin used for cooling water purification in a nuclear power plant; and is (are) composed mainly of sodium chloride in the waste generated at the step for removal of hydrogen chloride gas contained in the combustion gas emitted from an incinerator of a nuclear facility. In the present process, the acid radical of sodium compound becomes as a gas and vaporizes at the anode side during electrolysis. This gas differs depending upon the kind of the sodium compound fed into the anode side and is decomposed or recovered in a manner suitable for the gas.

For example, when the sodium compound(s) in the radioactive waste is (are) composed mainly of sodium nitrate, a nitrogen oxide gas (NOx) is generated at the anode side during electrolysis, and this gas can be recovered, as necessary, as nitric acid by being absorbed by water. When the recovery of the gas is unnecessary, the gas may be subjected to catalytic reduction with ammonia gas (used as a denitrating and reducing agent) for decomposition into nitrogen and water and can be discharged as harmless substances. When electrolysis is conducted by using, as the catholyte, a melt containing sodium hydroxide and feeding steam into the catholyte, hydrogen gas is generated at the cathode side, and this hydrogen gas may be used as a denitrating and reducing agent for decomposition of the above-mentioned nitrogen oxide gas into nitrogen and water.

When the sodium compound(s) in the radioactive waste is (are) composed mainly of sodium chloride or sodium sulfate, the sodium chloride or sodium sulfate generates chlorine gas ($Cl_2$) or sulfur oxide gas (SOx) by electrolysis. These gases are non-radioactive and can be discharged as a non-radioactive waste after being absorbed by a sodium hydroxide absorbent. Incidentally, as the sodium hydroxide absorbent, there can be used sodium hydroxide formed at the cathode side.

The β-alumina used as a permeable membrane in the present invention exhibits its sodium ion permeability only when it is heated to about 300° C. or higher. Therefore, the operating temperature of β-alumina during electrolysis is preferably 300° C. or higher. (This applies also to when β"-alumina or β'"-alumina is used in place of β-alumina.)

When the sodium compound contained in the radioactive waste is sodium nitrate, electrolysis can be carried out at a temperature slightly higher than the melting point (308° C.) of the sodium nitrate and the melting point (328° C.) of the sodium hydroxide used as the catholyte. When the sodium compound contained in the radioactive waste is sodium chloride or sodium sulfate, electrolysis at a high temperature exceeding the melting point (800° C.) of the sodium chloride or the melting point (884° C.) of the sodium sulfate is not desirable from the standpoints of required apparatus and obtainable energy efficiency. Therefore, in such a case, it is preferable that a low-melting eutectic compound other than sodium, such as zinc chloride ($ZnCl_2$, melting point =313° C.) or the like is added to the molten salt (the anolyte) to lower the latter's melting point and conduct electrolysis at a relatively low temperature.

In order to prevent the formation of metallic sodium (which is highly reactive) during electrolysis, it is preferable to control the voltage employed during electrolysis, at a given level. Since the minimum voltage necessary for metallic sodium formation (which is about 3–5 V and is dependent upon the property of β-alumina) is electrochemically higher by about 1 V than the minimum voltage necessary for sodium hydroxide formation, formation of metallic sodium can be prevented by controlling the voltage between the anode and cathode at a level not lower than the minimum voltage necessary for sodium hydroxide formation but lower than the minimum voltage necessary for metallic sodium formation.

With respect to the materials for electrodes, graphite is used for the anode and nickel is used for the cathode, generally. Graphite, however, is corroded when the radioactive waste contains sodium nitrate. Therefore, it is preferable that nickel or a nickel alloy is used for the two electrodes.

In the present invention, it is preferable that prior to electrolysis of the molten salt, the radioactive waste or the molten salt thereof is deprived of an element(s) which hinders (hinder) the permeation of sodium ion through the permeable membrane (e.g. β-alumina). The element(s) which hinders (hinder) the permeation of sodium ion, refers (refer) to elements having an ionic radius or ionic charge similar to those of sodium, and includes (include) $Ca^{2+}$, $Pd^{2+}$, $Ag^{+}$, $K^{+}$ and/or $Ba^{2+}$. Since these elements can easily penetrate into the permeable membrane (e.g. β-alumina) and deteriorate the membrane, they are desired to be removed as necessary prior to electrolysis.

The element(s) which hinders (hinder) the permeation of sodium ion, can be removed by coprecipitation, filtration, ion exchange, adsorption or the like when removed from the radioactive waste, and by adsorption or the like when removed from the molten salt. In removal from the molten salt by adsorption, the adsorbent used is preferably an inorganic adsorbent such as β-alumina, zeolite, molecular sieve or the like. The form of the adsorbent used may be a powder or may be a layer through which the molten salt can pass.

The present invention is hereinafter described in more detail by way of Examples. However, the present invention is not restricted to these Examples.

EXAMPLE 1

Electrolysis was conducted as mentioned below, using an apparatus shown in FIG. 1, to examine the current efficiency and the purity of product (NaOH) obtained. In FIG. 1, 2 is an anode and 4 is a cathode, both being made of a nickel alloy. 6 is a permeable membrane made of β-alumina, and this membrane divides the inside of an electrolyzer 8 into an anode side chamber 12 and a cathode side chamber 10. 14 is a heater for heating the electrolyzer inside to a desired temperature.

In the apparatus of FIG. 1, sodium nitrate was introduced into the anode side chamber 12 and sodium hydroxide was introduced into the cathode side chamber 10, and they were kept in a molten state at 330° C. Then, while an argon gas containing steam was being fed into the cathode side chamber 10 via an alumina pipe 16, a DC of 4.5 V was applied between the electrodes 2 and 4. As a result, a current of 0.5 $A/cm^2$ density passed through the permeable membrane 6. By this electrolysis, NaOH was formed and $H_2$ gas was generated at the cathode side, and nitrogen oxide gas and oxygen gas were generated at the anode side. The current efficiency determined from the amount of electricity applied and the NaOH formed, and the purity of product obtained are shown in Table 1. Incidentally, this test was conducted three times under the same conditions.

TABLE 1

| Run No. | Current efficiency (%) | NaOH purity (%) |
|---|---|---|
| 1 | 100 | 99.9 or higher |
| 2 | 98 | 99.9 or higher |
| 3 | 99 | 99.9 or higher |

EXAMPLE 2

Figure 2:
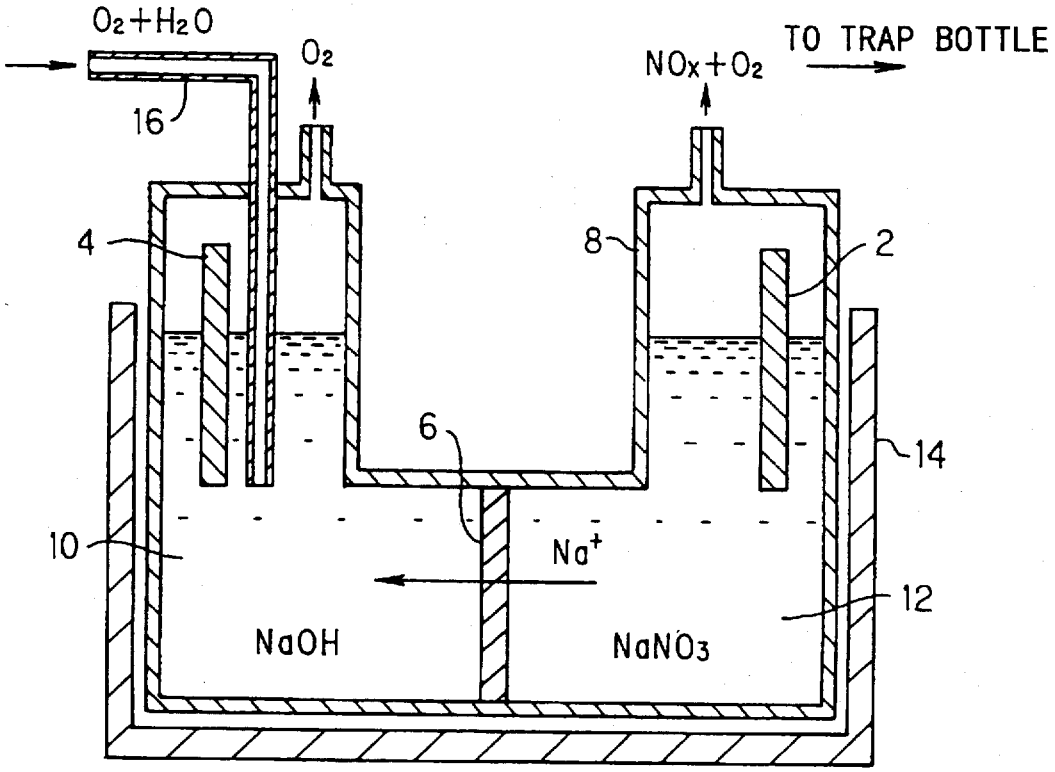
FIG. 2 is a drawing showing the outline of the apparatus used in Example 2.

Electrolysis was conducted as mentioned below, using an apparatus shown in FIG. 2, to examine the current efficiency and the purity of product (NaOH) obtained. In FIG. 2, 2 is an anode and 4 is a cathode, both being made of a nickel alloy. 6 is a permeable membrane made of β-alumina, and this membrane divides the inside of an electrolyzer 8 into an anode side chamber 12 and a cathode side chamber 10. 14 is a heater for heating the electrolyzer inside to a desired temperature.

In the apparatus of FIG. 2, sodium nitrate containing radioactive cobalt 60 was introduced into the anode side chamber 12 and sodium hydroxide was introduced into the cathode side chamber 10, and they were kept in a molten state at 330° C. Then, while an oxygen gas containing steam was being fed into the cathode side chamber 10 via an alumina pipe 16, a DC of 3.4 V was applied between the electrodes 2 and 4. As a result, a current of 0.5 A/cm$^2$ density passed through the permeable membrane 6. By this electrolysis, NaOH was formed at the cathode side but no $H_2$ gas was generated, and nitrogen oxide gas and oxygen gas were generated at the anode side. The current efficiency determined from the amount of electricity applied and the NaOH formed, the purity of product obtained, and the decontamination factor of radioactive substance obtained by dividing the concentration of radioactive cobalt 60 contained in $NaNO_3$, by the concentration of radioactive cobalt 60 contained in NaOH, are shown in Table 2. Incidentally, this test was conducted three times under the same conditions.

TABLE 2

| Run No. | Current density (%) | NaOH purity (%) | Decontamination factor |
|---|---|---|---|
| 1 | 99 | 99.9 or higher | $1 \times 10^4$ or more |
| 2 | 100 | 99.9 or higher | $1 \times 10^4$ or more |
| 3 | 99 | 99.9 or higher | $1 \times 10^4$ or more |

As described above, the present invention enables recovery, from a radioactive waste containing a radioactive substance(s) and a sodium compound(s), of metallic sodium or sodium hydroxide of extremely low radioactivity at a high purity (solid) at a high current efficiency. Further, in the present invention, since the acid radical in the anode side becomes a gas and vaporizes, the gas can be as necessary neutralized or decomposed and can be discharged or stored out of the facility as a non-radioactive substance. Furthermore, in the present invention, a radioactive waste can be treated with a compact apparatus, as compared with the conventional treatment by electrodialysis using an ion exchange membrane.

What is claimed is:

1. A process for treating a radioactive waste, which comprises drying a radioactive waste containing a radioactive substance(s) and a sodium compound(s), to convert it into a dried material, heating the dried material to convert it into a molten salt, and subjecting the molten salt to electrolysis using the salt as an anolyte and β-alumina as a sodium ion-permeable membrane.

2. A process according to claim 1, wherein metallic sodium is used as a catholyte in the electrolysis.

3. A process according to claim 1, wherein a melt containing sodium hydroxide is used as a catholyte and electrolysis is conducted with steam being fed into the catholyte.

4. A process according to claim 1, wherein a melt containing sodium hydroxide is used as a catholyte and electrolysis is conducted with steam and oxygen being fed into the catholyte.

5. A process according to claim 1, wherein the sodium compound(s) is (are) composed mainly of at least one sodium compound selected from sodium nitrate, sodium chloride and sodium sulfate.

6. A process according to claim 5, wherein the sodium compound(s) contains (contain) sodium nitrate and the nitrogen oxide gas (NOx) generated in the anode side is absorbed by water and recovered as nitric acid.

7. A process according to claim 5, wherein the sodium compound(s) contains (contain) sodium nitrate and the nitrogen oxide gas (NOx) generated in the anode side is subjected to catalytic reduction with ammonia and decomposed into nitrogen and water.

8. A process according to claim 5, wherein the sodium compound(s) contains (contain) sodium nitrate and the nitrogen oxide gas (NOx) generated in the anode side is subjected to catalytic reduction with the hydrogen gas which is generated at the cathode side by conducting electrolysis with steam being fed into the catholyte, and is decomposed into nitrogen and water.

9. A process according to claim 5, wherein the sodium compound contains sodium chloride and the chlorine gas ($Cl_2$) generated at the anode side is removed by a sodium hydroxide absorbent and discharged as a non-radioactive waste.

10. A process according to claim 5, wherein the sodium compound contains sodium sulfate and the sulfur oxide gas (SOx) generated at the anode side is removed by a sodium hydroxide absorbent and discharged as a non-radioactive waste.

11. A process according to claim 10, wherein the sodium hydroxide generated at the cathode side is used as the sodium hydroxide absorbent.

12. A process according to claim 9, wherein the sodium hydroxide generated at the cathode side is used as the sodium hydroxide absorbent.

13. A process according to claim 1, wherein a low-melting eutectic compound other than sodium is added to the anolyte.

14. A process according to claim 1, wherein β-alumina is operated at a temperature of 300° C. or higher during the electrolysis.

15. A process according to claim 1, wherein β"-alumina or β'"-alumina is used in place of β-alumina.

16. A process according to claim 1, wherein electrolysis is conducted by keeping the voltage between the anode and the cathode at a level not lower than the minimum voltage at which sodium hydroxide is formed but lower than the minimum voltage at which metallic sodium is formed.

17. A process according to claim 1, wherein prior to the electrolysis of the molten salt, the radioactive waste or the molten salt thereof is deprived of an element(s) which hinders (hinder) the permeation of sodium ion through the permeable membrane.

18. A process according to claim 17, wherein the element (s) which hinders (hinder) the permeation of sodium ion through the permeable membrane, is (are) $Ca^{2+}$, $Pd^{2+}$, $Ag^{+}$, $K^{+}$ and/or $Ba^{2+}$.

19. A process according to claim 17, wherein the element (s) which hinders (hinder) the permeation of sodium ion through the permeable membrane, is (are) removed from the radioactive waste by coprecipitation, filtration, ion exchange or adsorption.

20. A process according to claim 17, wherein the element (s) which hinders (hinder) the permeation of sodium ion through the permeable membrane, is (are) removed from the molten salt by adsorption.

21. A process according to claim 20, wherein β-alumina, zeolite or a molecular sieve is used as an adsorbent for the adsorption.

22. A process according to claim 1, wherein nickel or a nickel alloy is used for both the anode and the cathode.

* * * * *